US006402177B1

(12) United States Patent
Carmona et al.

(10) Patent No.: US 6,402,177 B1
(45) Date of Patent: Jun. 11, 2002

(54) HITCH ASSEMBLY FOR THE FRONT FRAME OF AN ARTICULATED CONSTRUCTION MACHINE

(75) Inventors: Eliseo J. Carmona, Elmhurst, IL (US); Yon C. Chong, Tiara (SG); Timothy S. Conroy, Aurora, IL (US); James K. Mathieu, Plano, IL (US); Daniel R. Neitzel, Elgin, IL (US); Craig W. Riediger, Kobe (JP); Charles F. Sieck, Dunlap; Richard C. Zielie, Yorkville, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/043,182

(22) PCT Filed: Mar. 14, 1997

(86) PCT No.: PCT/US97/04182

§ 371 (c)(1),
(2), (4) Date: Aug. 16, 1999

(87) PCT Pub. No.: WO98/02620

PCT Pub. Date: Jan. 22, 1998

(30) Foreign Application Priority Data

Jul. 12, 1996 (US) ..... 08680341

(51) Int. Cl.[7] ..... B62D 13/02
(52) U.S. Cl. ..... 280/442; 180/418
(58) Field of Search ..... 280/400, 442, 280/443; 180/235, 418; 172/272, 273

(56) References Cited

U.S. PATENT DOCUMENTS

| | | | | |
|---|---|---|---|---|
| 3,384,196 A | | 5/1968 | Fielding | 180/79.2 |
| 3,805,908 A | | 4/1974 | Thompson | 180/51 |
| 4,042,053 A | | 8/1977 | Sieren et al. | 180/51 |
| 4,087,101 A | | 5/1978 | Shimazaki et al. | 280/5 |
| 4,154,456 A | * | 5/1979 | Jensen et al. | 280/494 |
| 4,349,307 A | * | 9/1982 | Klem | 414/686 |
| 4,379,568 A | * | 4/1983 | Kerkman | 280/400 |
| 4,444,409 A | * | 4/1984 | Garrison | 280/492 |
| 4,502,709 A | * | 3/1985 | Schaeff | 280/758 |

FOREIGN PATENT DOCUMENTS

| | | | |
|---|---|---|---|
| JP | 61-81279 | * | 4/1986 |

* cited by examiner

*Primary Examiner*—Brian L. Johnson
*Assistant Examiner*—Avraham H. Lerner
(74) *Attorney, Agent, or Firm*—William C. Perry; James R. Smith; Liza J. Meyers

(57) ABSTRACT

In many types of construction machines, the frame assembly comprises a rear frame that supports the engine and drive train components and a front frame that supports the work implement. In this type of machine, the two frames are normally pinned together and the front frame is articulated with respect to the rear frame by a pair of steering cylinders to provide steering for the machine. In the area in which the two frames are pinned together it is necessary to provide structural support, especially in the hitch area of the front frame. The present invention provides a front frame assembly (12) that has an upper and lower hitch plate (118, 120) that are positioned between and secured to the rear portion of a pair of side plates (62, 64) defined by the front frame assembly (12). A first support plate (128) extends between and is secured to the side plates (62, 64) and defines an upper and lower end portion (172, 176) that are secured to the respective upper and lower hitch plates (118, 120) to provide uninterrupted support therebetween.

7 Claims, 5 Drawing Sheets

HITCH ASSEMBLY FOR THE FRONT FRAME OF AN ARTICULATED CONSTRUCTION MACHINE

TECHNICAL FIELD

This invention relates to a frame assembly and more particularly to the hitch assembly on the front frame of a construction machine.

BACKGROUND ART

In the operation of construction machines, it has been found desirable to steer the machine by rotating the front portion of the machine with respect to the rear portion. In order to do this, it is necessary to provide two separate frames that are pinned together about a vertical axis and extend hydraulic cylinders therebetween to obtain the desired rotation or articulation. Typically, the engine and drive train components are mounted on the rear portion of the machine and the work implement is mounted on the front portion of the machine.

In the case of some machines, the articulated wheel loader, for example, the front frame portion is subject to extremely high loads from several different sources. One primary source occurs during operation of the work implement. The work implement is typically attached to the front frame by a pair of lift arms each of which are raised and lowered by a pair of lift cylinders that extend between each lift arm and the front frame. The weight of the lift arms and loaded work implement are the source of substantially loading and it is necessary to provide a front frame assembly with sufficient width to accommodate such loading.

Yet another source of loading occurs during the steering function of the vehicle. Since the front axle is mounted to the front frame, there must be substantial support for it as it steered over all kinds of terrain. The forces applied by the steering cylinder to rotate the front frame with respect to the rear frame to steer the axle are also quite large. The support brackets for the steering cylinders are normally positioned on the sides of the front frame assembly at locations that are spaced from the axle centerline, through which the forces are transferred. As this spacing increases, so to do the forces passing therethrough, which ultimately requires exceptionally large support brackets for mounting structures.

A great deal of these forces are transmitted from the front frame to the rear frame through the hitch components. For that reason, the area around each of the hitch brackets, especially on the front frame, are normally reinforced by a plurality of support plates. Typically these support plates are isolated around each of the individual hitch plates and numerous plates are required to provide adequate support.

All these factors inherently result in a structure that is quite large in both height and width. With the increase in size however, come several disadvantages. The overall complexity and weight are exceptionally costly in terms of the numbers of components that must be welded together and the expense of material. Additionally, the operation of the machine is hampered because the large size of the structure can reduce the operators visibility to the work implement. This especially true with respect to the line of sight to the base and the corners of the implement.

The present invention is directed to overcoming one or more of the problems set forth above.

DISCLOSURE OF THE INVENTION

In one aspect of the present invention, a hitch assembly is provided for the front frame assembly of an articulated machine that includes a pair of side plates that have first and second end portions and are positioned in spaced, parallel relation to one another. Upper and lower hitch plates are positioned between and secured to the side plates at the second end portions thereof with the lower hitch plate being vertically spaced from the upper hitch plate. A first support plate having an upper end portion secured to the upper hitch plate and a lower end portion secured to the lower hitch plate is positioned between and is secured to each of the side plates along the entire lengths of the opposing sides of the support plate.

With a hitch assembly as set forth above, support for the loads that are directed through the hitch assembly during operation of the machine are accommodated by a structure that utilizes a minimum of structural components thus reducing the complexity and cost of the overall structure as well the manufacturing and assembly processes.

BEST MODE FOR CARRYING OUT THE INVENTION

Figure 1:
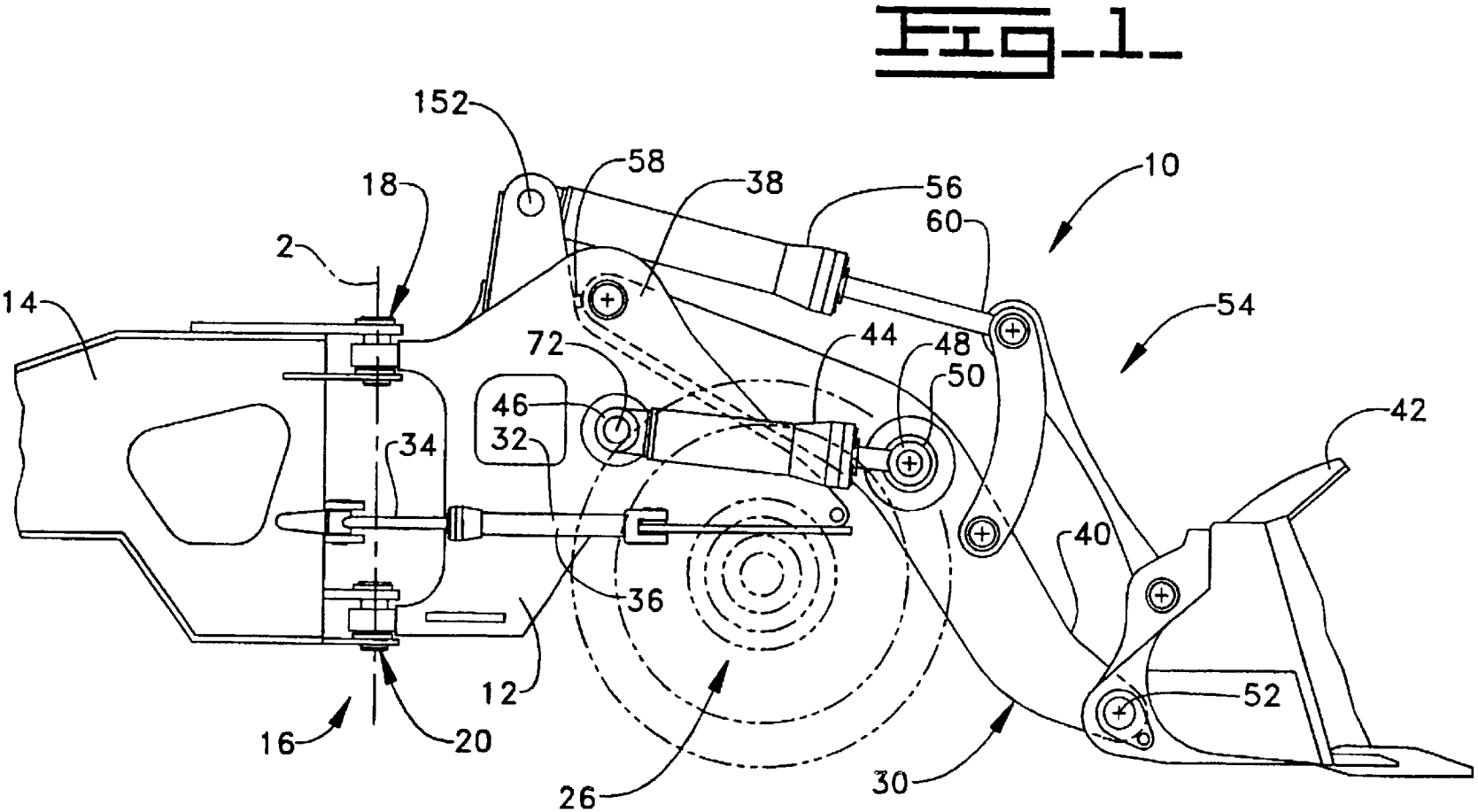
FIG. 1 is a diagrammatic, side view of a portion of a construction machine that embodies the principles of the present invention.
Figure 2:
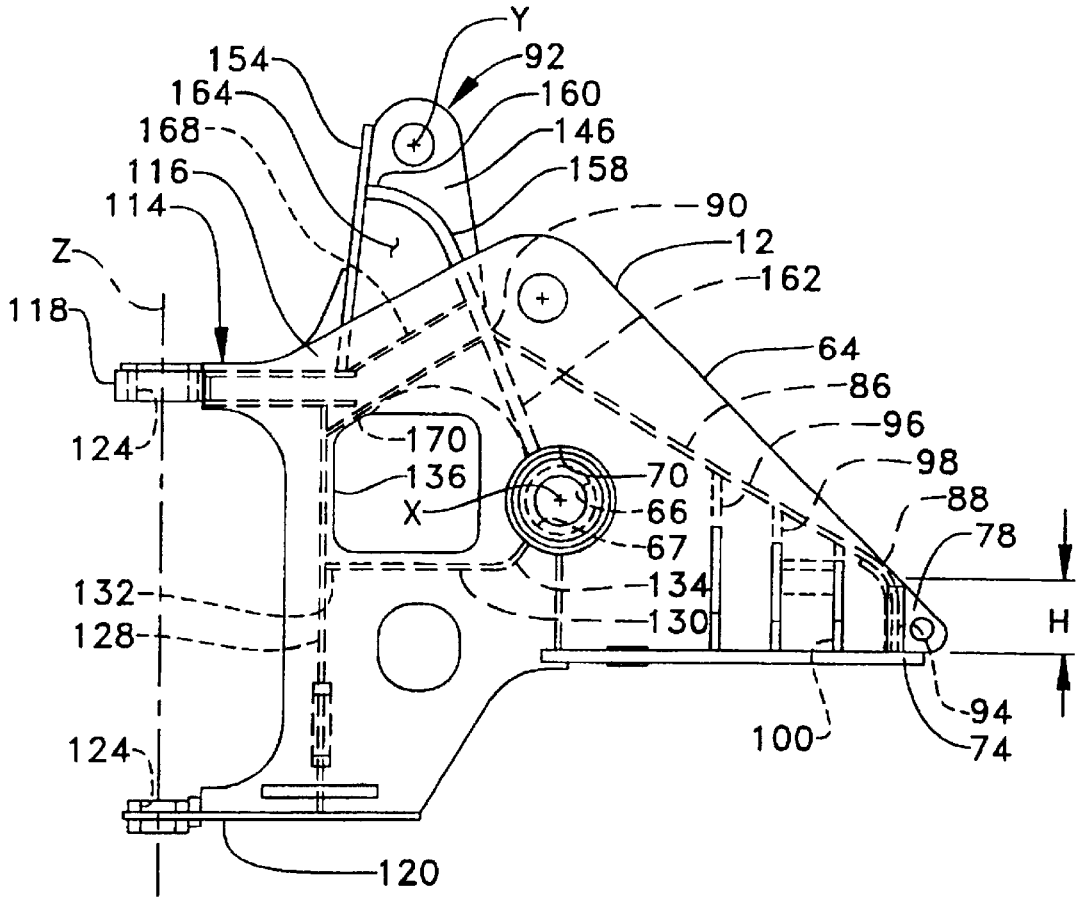
FIG. 2 is a diagrammatic side elevational view of the front frame portion of the construction machine shown in FIG. 1.

Referring now to the drawings, particularly FIG. 1, it can be seen that a construction machine 10 is shown. The machine has a first, or front frame assembly 12 that is pivotally mounted to a second or rear frame assembly 14. The two frame members define a hitch assembly 16 that has spaced apart mounting portions 18 and 20 that are pinned together along a generally vertical axis. The rear frame assembly mounts an engine and a drive train (not shown) that provides motive traction to both a front and rear axle assembly that are mounted on the respective front and rear frames. A pair of wheels are supported by the each axle assembly and provide movement of the machine in a well known manner. In addition to supporting a front axle assembly, shown generally at 26, the front frame 12 provides the support for a lift arm assembly 30. The front frame 12 is rotatable with respect to the rear frame 14 about the pivotal mounting therebetween by a pair of steering cylinders 32 (one shown) that are mounted on opposite sides of the hitch assembly. Each steering cylinder has a first end portion 34 mounted to the rear frame and a second end portion 36 mounted to the front frame in a manner to be described in greater detail hereinafter. Extension and retraction of the steering cylinders causes the front frame to articulate with respect to the rear frame to provide steering for the machine.

The lift arm assembly 30 has a first end portion 38 that is pivotally mounted to the front frame 12 and a second end portion 40 that mounts a work implement 42, such as a bucket. The lift arm is moved in a generally vertical plane by a pair of lift cylinders 44 (one shown) that have a first end portion 46 pivotally mounted to the front frame 12 and a second end portion 48 pivotally mounted to the lift arm at a location shown at 50. The work implement 42 is pivotally mounted to the lift arm at 52 and is rotatable about the mounting by a tilt arrangement 54 that is mounted between the lift arm and the work implement. A tilt cylinder 56 has a first end portion 58 that is rotatably mounted to the front frame 12 and a second end portion 60 that is connected to the tilt arrangement 54. Rotation of the implement about its mounting occurs as a result of the extension and retraction of the tilt cylinder.

Turning now to FIGS. 2–5, the front frame 12 assembly can be seen in greater detail. The front frame assembly 12 is defined by a plurality of main structural members as well as a plurality of subassemblies that provide support for or accommodate loading from the various hydraulic cylinders or other components attached to the frame assembly.

Figure 3:
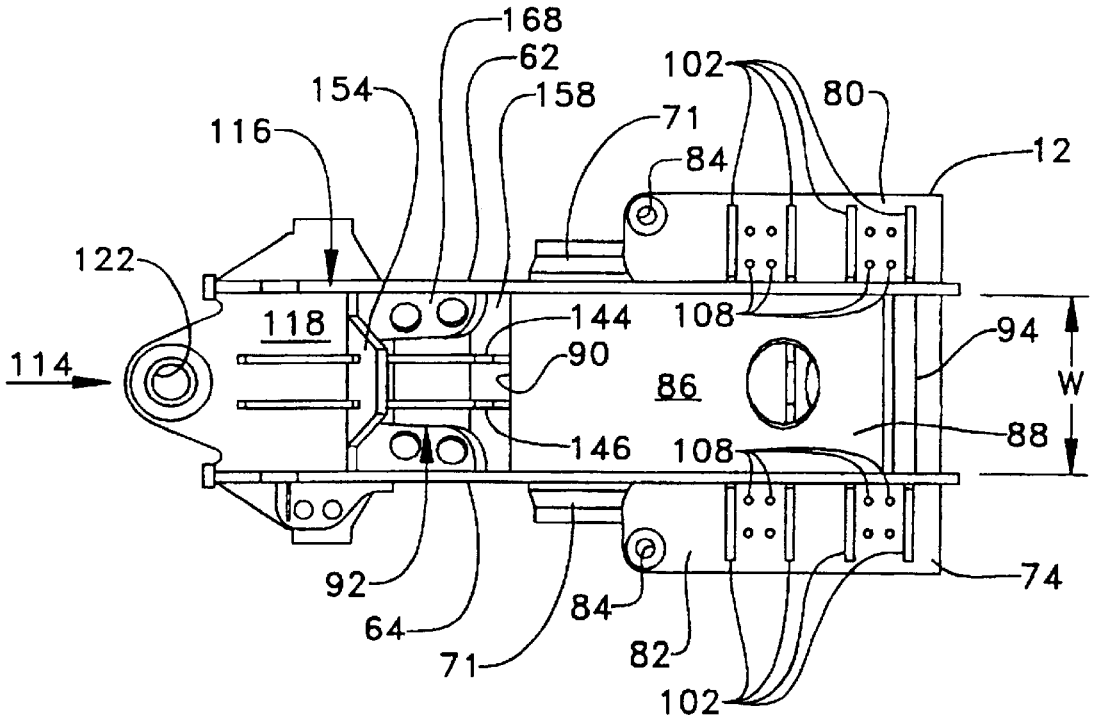
FIG. 3 is a diagrammatic top view of the frame member shown in FIG. 2.
Figure 4:
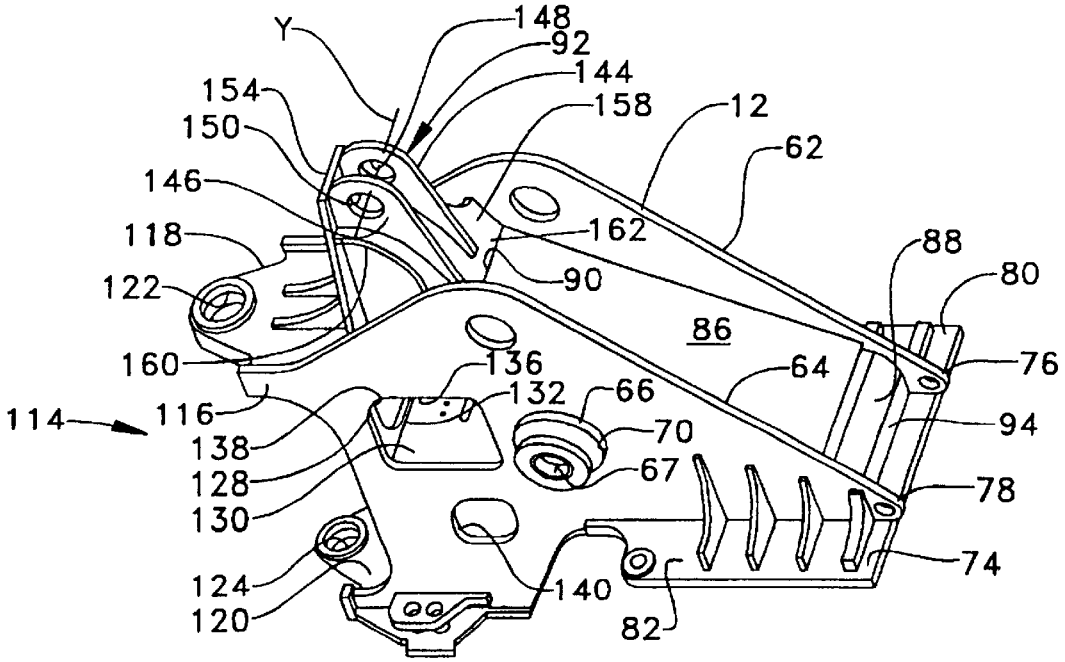
FIG. 4 is a diagrammatic isometric view of the front frame member as viewed from an elevated position at the forward portion of the machine on the operator's right side.
Figure 5:
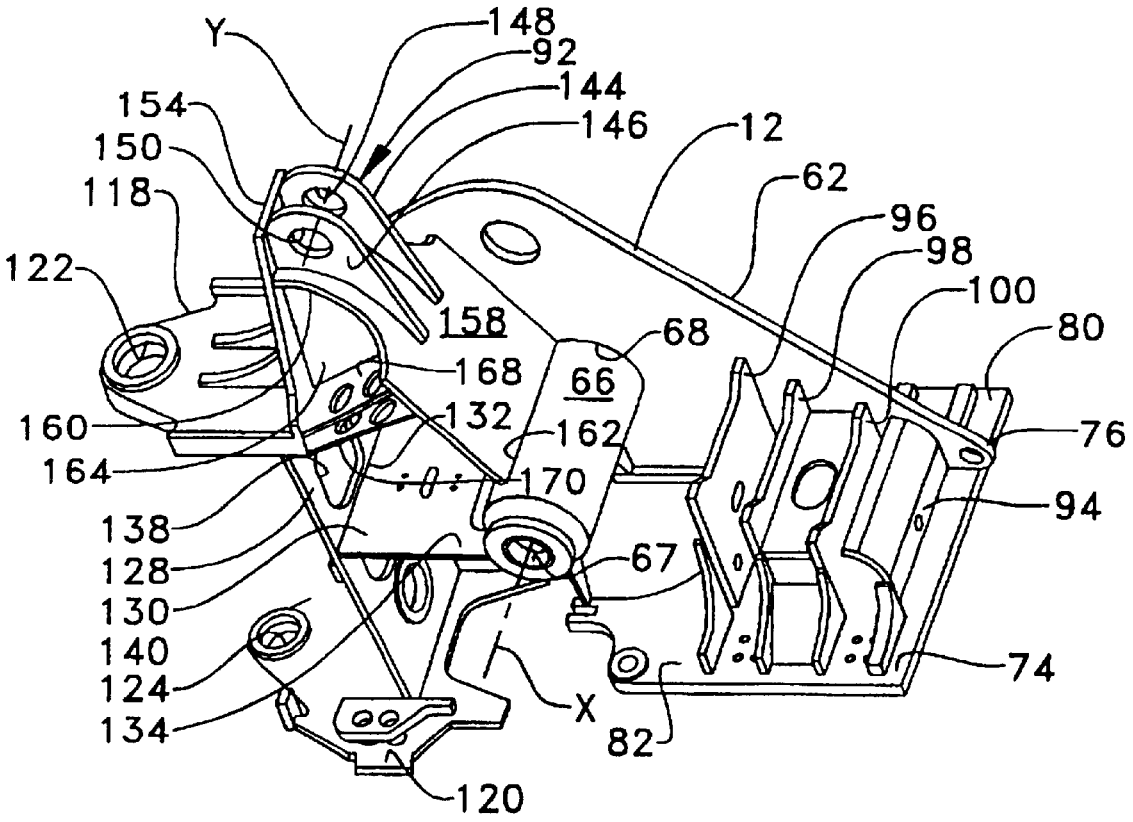
FIG. 5 is a diagrammatic isometric view similar to that of FIG. 4 with portions of the frame removed to more clearly view the structure.

The main structural components of the front frame assembly include a pair of main sides plates 62 and 64 that are generally oriented in a longitudinal direction with respect to a centerline of the machine, and are spaced from one another a preselected width W (FIG.3). The width W is sufficient to receive the first end portion 38 of the lift arm assembly 30 therebetween.

A cast tubular member 66 extends between the side plates 62 and 64 and is received in bores 68 and 70 that are formed in the respective sides plates 62 and 64 along a common axis X. The tubular member 66 is fixed to the side plates so that the end portions extend beyond the respective side plates to form an outwardly extending stub shaft 71 that serves as a mounting support for the lift cylinders 44. The tubular member defines a bore 67 that is sufficient to receive a pin assembly 72 (FIG.1) that pivotally mounts the first end portions 46 of the lift cylinders 44 at a location that is outwardly adjacent each of the main side plates. It is to be understood that while shown and described as a tubular member, a similar function could be obtained by a support member having a box section. Alternatively, a stub shaft could be individually supported by each side plate with additional bracketing on each individual side plate without departing from the intent of the invention.

A first main support plate 74 is transversely positioned with respect to the side plates 62 and 64 and is secured thereto at a first or forwardly extending end portion 76 and 78 of each main side plate, to lie in a generally horizontal plane. The first main support plate 74 is substantially planar and extends laterally beyond each side plate to define a wing 80 and 82 on opposing sides of the side plates 62 and 64. The first main support plate defines a pair of bores 84 at a rearmost portion thereof, that extend through the first main plate. The bores 84 are adapted for receiving a pin assembly utilized to mount the second end portion 36 of one of the steering cylinders 32.

A second main support plate 86 is positioned between and is connected to the main side plates 62 and 64 and has a first end portion 88 that is affixed to the first main support plate 74 and a second end portion 90 that is secured to a tilt tower assembly 92 that will be described in greater detail hereinafter. The majority of the second main support plate 86 is positioned at an angle to the first main support plate and extends upwardly toward the rear portion of the frame assembly 12. The first end portion 88 of the second main support plate 86 is angled or curved downwardly and defines a vertically extending wall 94 that has a preselected height H that intersects with the angled portion of the second main support plate.

A plurality of spreader plates or gussets 96, 98, and 100 are positioned internally between the main side plates 62 and 64. As can best be seen in FIG. 5, each gusset plate is secured to the respective side plates, the first, transversely extending, main support plate 74 and at least a portion thereof is secured to the angled, second main support plate 86. The gussets are longitudinally spaced from one another along the forward portion of the frame assembly. A plurality of outer gussets, which are all indicated by the reference numeral 102, are positioned on each of the wings 80 and 82 defined by the first main support plate 74 and are aligned with the internally positioned gussets 96, 98 and 100. A plurality of mounting holes 108 are formed in the first main support plate 74 on the forward portion thereof in the area of the spreader plates and gussets. The mounting holes 108 receive suitable fasteners (not shown) that mount the front axle assembly directly to the first main support plate 74. The spreader plates and gussets provide substantial torsional support for the forward portion of the frame assembly 12 to accommodate the loading applied by the axle assembly as the machine is operated.

A hitch assembly 114 is defined on a second or rearwardly directed end portion 116 of the front frame assembly 12. A first, or upper hitch plate 118 extends transversely between the main side plates 62 and 64 and is fixedly secured thereto by welding for example. A second, or lower hitch plate 120 also has at least a portion thereof positioned between the main side plates and is also welded thereto at a lower extremity of the frame assembly 12 at a vertically spaced location from the upper hitch plate 118. Each hitch plate 118 and 120 defines a bore 122 and 124 respectfully, that are aligned with one another on the vertical pivot axis Z about which the front and rear machine frames articulate. A first hitch support plate 128 extends between the upper and lower hitch plates 118 and 120 and is transversely positioned between the main side plates 62 and 64. The hitch support plate 128 is secured to both hitch plates at its upper and lower ends and as well as both side plates. A second hitch support plate 130 extends between the first hitch support plate 128 and the tubular member 66. The second hitch support plate 130 is generally horizontally oriented and has a first end portion 132 that is attached to the first hitch support plate 128 at the approximate midportion thereof and a second end portion 134 that is slightly curved upwardly to engage the tubular member 66 at an angle that will intersect the axis X defined by the tubular member 66. The second hitch support plate 130 is positioned adjacent an opening 136 in each of the main side plates 62 and 64 and provides a support platform for various machine components, such as hydraulic valves utilized in the operation of the tilt and lift cylinders, in an area that is accessible for service. A pair of openings 138 and 140 are defined in the first hitch support plate 128 above and below the second hitch support plate 130 for the same purpose.

The tilt tower arrangement, shown generally at 92 is positioned between and secured to the main side plates 62 and 64. The tilt tower arrangement includes a pair of generally vertically oriented mounting plates 144 and 146 that are transversely spaced from one another a distance sufficient to receive the tilt cylinder 56. The mounting plates 144 and 146 define bores 148 and 150 that are aligned along a common axis Y and receive a pin assembly 152 (FIG. 1) that pivotally mounts the first end portion 58 of the tilt cylinder 56. The mounting plates 144 and 146 are mounted to a generally vertical, first tilt tower support plate 154 that is positioned transversely between the side plates 62 and 64 on the rear side of the mounting plates 144 and 146. A first or lower end portion 156 of the first tilt tower support plate 154 is welded to the respective side plates 62 and 64 and the upper hitch plate 118. A second tilt tower support plate 158 is portioned between and is affixed to the side plates 62 and 64. The second tilt tower support plate 158 has a first end portion 160 that is secured to the first tilt tower support plate 154 and a second end portion 162 that is secured to the tubular member 66. The first end portion 160 is curved and serves as a base plate for the mounting plates 144 and 146. The second end portion 162 is generally planar and is positioned to extend at an angle that substantially intersects with the axes X and Y that are respectively defined by the tubular member 66 and the bores 148 and 150 defined by is the mounting plates 144 and 146 respectively. The second end portion 162 engages and is secured to the second end portion 90 of the second, or angled main support plate 86. A pair of support plates, one of which is shown at 164, are provided for each of the mounting plates 144 and 146 respectively. Each support plate 164 and 166 is vertically aligned with one of the mounting plates and is mounted to both the first and second tilt tower support plates 154 and 158 along two surfaces thereof. Because the mounting plates and support plates are aligned on opposing sides of the second tower support plate, it is to be understood that they could be one continuous plate without departing from the invention. However, for manufacturing purposes, it is beneficial to separate them into two individual plates positioned as described.

Torsional support for the tilt tower arrangement 142 is provided by a pair of upper and lower plates 168 and 170 that extend between the upper hitch plate 118 and second tower support plate 158. The upper torsional plate 168 defines a first end portion 172 that extends along and is welded to an upper edge 174 defined on the forward portion of the upper hitch plate 118 along the juncture between the upper hitch plate 118 and the first tower support plate 154. A second end portion 176 of the upper torsional plate is secured to the second tower support plate 158. The lower torsional plate 170 defines a first end portion 178 is secured to a lower edge 180 defined on the forward portion of the upper hitch portion 118. A second end portion 182 of the lower torsional plate 170 is secured to the second tower support plate 158 at a location that is spaced vertically from the second end portion 176 of the upper torsional plate. The upper and lower plates 168 and 170 are spaced from one another a distance that is approximately the height of the upper hitch plate 118 and define a box-shaped configuration to provide torsional stiffness to this area of the front frame 12. While not clearly shown, the lower plate 170 includes a portion that is positioned between the support plates 164 and 166. This portion of the lower plate may be a separate plate that may or may not be aligned with the lower plate 170.

Industrial Applicability

The frame assembly 12 set forth above, mounts a lift arm assembly that may be positioned between the main side plates 62 and 64. In doing so the overall width of the frame assembly may be much narrower that prior frame assemblies. Also, the vertical height of the frame assembly at the forward end is also greatly reduced because of the second or angled main support plate 86. In fact the vertical height H established by the angled main support plate may fall within a range of 0.2 to 0.6 of the preselected width established by the side plates 62 and 64. These two physical components provide an operator exceptional visibility to the implement both down the center of the machine as well as to the corners of the work implement.

In addition, the load transfer between the front and rear frames 12 and 14 respectively, is extremely efficient. This is especially true with the mounting of the steering cylinders 32. Actuation of the steering cylinders will cause the front frame to articulate about the vertical axis A to steer the machine. This can be the source of extreme loading. The steering cylinders are mounted directly to the first main support plate 74 and are essentially positioned in line with it. This linear transfer of forces eliminates the need for substantial support brackets thereby reducing weight and cost both in components and manufacturing and assembly.

The hitch assembly 114 is another source of great loading. The subject invention utilizes a single upper and lower hitch plate 118 and 120 respectively, that are interconnected by a continuous first hitch support plate 128. The first hitch support plate is secured on all sides. The upper and lower extremities are welded to the upper and lower hitch plates and the opposing side portions are welded to each side plate 62 and 64. Prior designs have not utilized continuous plates in this manner and have used extensive box sections to provide the required support for the upper and lower hitch plates.

With the frame assembly set forth above, it can be seen that a maximum of structural integrity is obtained with a relatively few components. The positioning of the various plates provides extremely efficient load transfer allows the overall structure to be reduced in size. With the reduction in size, the overall visibility to the forward portion of the machine is greatly increased which will result in an increase in machine performance and productivity. The reduction in size and components also results in a reduction in manufacturing costs since the structure is more easily fabricated.

Other aspects, objects and advantages of this invention can be obtained from a study of the drawings, the disclosure and the appended claims.

What is claimed is:

1. A hitch assembly (16) for a front frame (12) of an articulated machine (10), comprising:

a pair of side plates (62,64) having a first (76,78) and second (116) end portions and being positioned in spaced, parallel relation to one another;

a tubular member (66) having a bore (67) defined therethrough along a first axis (X) is positioned between and secured to the side plates (62,64);

an upper hitch plate (118) positioned between and secured to the side plates (62,64) at the second end portions (116) thereof;

a lower hitch plate (120) positioned between and secured to the side plates (62,64) at the second end portions (116) thereof at a location that is vertically spaced from the upper hitch plate (118); and a first support plate (128) having an upper end portion secured to the upper hitch plate (118) and a lower end portion secured to the lower hitch plate (120), said first support plate (128) being positioned between and secured to each of the side plates (62,64) along the entire lengths of opposing sides of the support plate (128).

2. The hitch assembly (16) as set forth in claim 1 wherein a tower assembly (92) having a pair of bores (148,150) defined along a second axis (Y) that is parallel to the first axis (X), is positioned between and secured to the first and second side plates (62,64).

3. The hitch assembly (16) as set forth in claim 2 wherein the tower assembly (92) defines a first tilt tower support plate (154) having a lower end portion (156) positioned between and secured to the side plates (62,64) and the upper hitch plate (118).

4. The hitch assembly (16) as set forth in claim 3 wherein a second tilt tower support plate (158) is positioned between and secured to the first tilt tower support plate (154) and the tubular member (66) and is generally aligned between the first and second axes (X,Y).

5. The hitch assembly (16) as set forth in claim 4 wherein an-upper torsion plate (168) having first and second end portions (172,176) is positioned between and secured to the side plates (62,64) with the first end portion (172) thereof secured to the lower end portion of the first tilt tower support plate (154) and an upper edge (174) defined by the upper hitch plate (118) and the second end portion (176) thereof secured to the second tilt tower support plate (158).

6. The hitch assembly (16) as set forth in claim 5 wherein a lower torsion plate (170) having first and second end portions (178,182) is positioned between and secured to the side plates (62,64) with the first end portion (178) thereof secured to a lower edge (180) defined by the upper hitch plate (118) and the second end portion (182) is secured to the second tilt tower support plate (158), said lower torsion plate (170) being vertically spaced from the upper torsion plate (168) to form a box configuration between the upper hitch plate (118) and the second tilt tower support plate (158).

7. The hitch assembly (16) as set forth in claim 1 wherein a second hitch support plate (130) is positioned between and secured to the side plates (62,64) and defines a first end portion (132) that is secured to the first hitch support plate (128) at the approximate midportion thereof and a second end portion (134) that is secured to the tubular member (66).

* * * * *